United States Patent [19]

Leaphart

[11] Patent Number: 4,714,353

[45] Date of Patent: Dec. 22, 1987

[54] LAUNDERING BAG FOR PAIRED ITEMS

[76] Inventor: C. Mark Leaphart, 500 Zimalcrest Rd., Crossroad Apts., Columbia, S.C. 29210

[21] Appl. No.: 893,695

[22] Filed: Aug. 6, 1986

[51] Int. Cl.[4] ..... B65D 30/04

[52] U.S. Cl. ..... 383/117; 383/102; 383/33; 383/42; 220/339; 220/401; 150/48

[58] Field of Search ..... 383/103, 102, 117, 119, 383/42, 62, 80, 33; 220/337, 72.1, 339, 401, DIG. 15; 217/124; 150/48, 51, 50; 229/52 AC

[56] References Cited

U.S. PATENT DOCUMENTS

| | | | |
|---|---|---|---|
| 755,085 | 3/1904 | Viano | 383/33 |
| 3,642,967 | 2/1972 | Doll | 383/117 |
| 3,756,300 | 9/1973 | Nalle, Jr. | 383/33 |
| 3,848,766 | 11/1974 | Ganti et al. | 229/52 AC |
| 4,010,785 | 3/1977 | Patik | 383/117 |
| 4,203,479 | 5/1980 | Mathens | 383/33 |
| 4,228,834 | 10/1980 | Desnick | 383/117 |
| 4,301,961 | 11/1981 | Rodish | 383/117 |

*Primary Examiner*—Willis Little

*Attorney, Agent, or Firm*—Bailey & Hardaway

[57] ABSTRACT

A novel laundering bag, particularly for paired items, having a reinforcement structure for maintaining the bag in an uncollapsed state.

12 Claims, 7 Drawing Figures

LAUNDERING BAG FOR PAIRED ITEMS

BACKGROUND OF THE INVENTION

This invention relates generally to the art of laundering bags and more specifically to a laundering bag with a reinforcement structure to maintain it in an uncollapsed state.

Various laundering bags exist within the prior art for use during the cleaning process. One such bag is disclosed in U.S. Pat. No. 4,388,739 to Martin et al which specified a washing bag for drapes or curtains, the design of which incorporates an auxiliary compartment for accommodating the hooks or other attachment elements used to hang the fabric.

Another bag is disclosed in U.S. Pat. No. 2,602,482 to Lyon wherein an open-mesh bag is used to enclose and to protect garments during the washing process.

Whereas the prior art provides various laundering bags, the need for improvement in design and construction materials exists, particularly to allow the bag to be maintained in an uncollapsed state.

SUMMARY OF THE INVENTION

It is thus an object of this invention to provide a novel laundering bag for paired items whereby the items are conveniently collected prior to washing, are maintained together during the laundering process to prevent loss, and are separated from other items being laundered for easy access.

It is a further object of this invention to provide a laundering bag of novel design to insure that the items being laundered are not unduly restricted and that they receive maximum exposure to the cleaning solution and circulated air during the washing and drying processes.

These as well as other objects are accomplished by a laundering bag for paired items comprising open weave fabric or plastic net, a reinforcement structure maintaining the open weave fabric or plastic net in an uncollapsed state, an opening at one end of the open weave fabric or plastic net and a means for closing the opening.

DETAILED DESCRIPTION OF THE DRAWINGS

Figure 1:
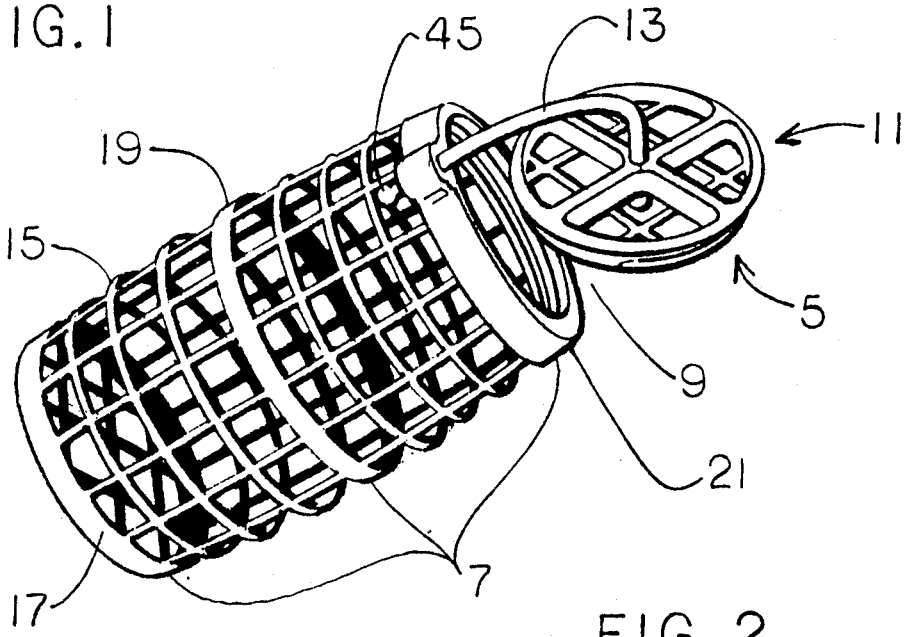
FIG. 1 of the drawings illustrates a longitudinal perspective view of the laundering bag in accordance with this invention showing the general construction thereof.

In accordance with this invention it has been found that the laundering bag for paired items to be herein described may be used to collect items, to contain them during the washing and drying processes so that no loss occurs and so that they are easily retrieved after laundering, and to store the items until further use. The apparatus of this invention is lightweight yet sturdy, having ribs of rigid plastic supporting walls of flexible and non-absorbent plastic, preferably polyvinylchloride. The support structure maintains the laundering bag in an uncollapsed state so that items within it are not unduly restricted, insuring proper washing and drying. The open weave structure of the plastic walls allows maximum circulation of cleaning solutions and air for the washing and drying processes. In addition, the lid of the apparatus is permanently connected to the laundering bag by a flexible plastic cord, also of PVC (polyvinylchloride), to prevent loss. Other advantages will be apparent from the following description and reference to the various figures of the drawing.

FIG. 1 of the drawings illustrates a perspective view of the laundering bag for paired items 3 in accordance with this invention including open weave fabric or plastic net 5, a reinforcement structure 7 to maintain the open weave fabric or plastic net 5 in an uncollapsed state, and opening 9 at one end for inserting items into the bag and a means 11 for closing the opening 9, including cord 13.

Figure 2:
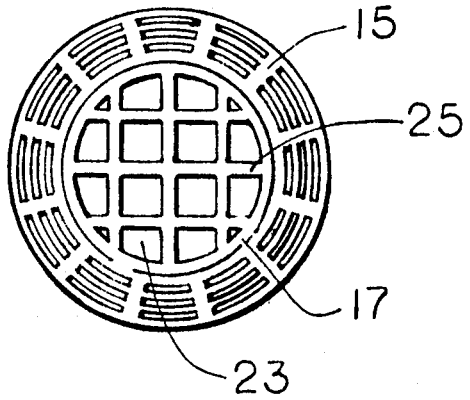
FIG. 2 of the drawings is an end perspective view of the laundering bag in accordance with this invention.
Figure 3:
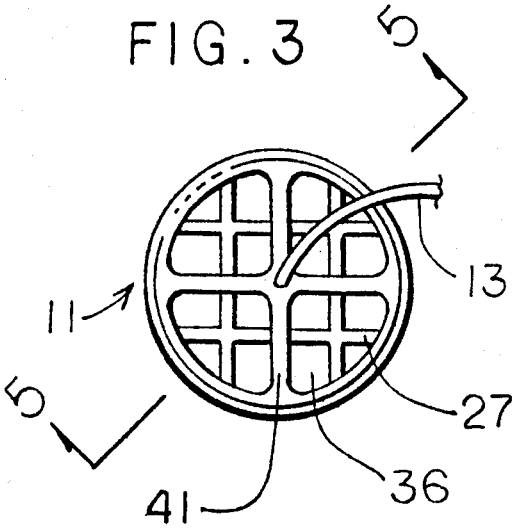
FIG. 3 of the drawings is a top perspective view of the means for closing the opening to the laundering bag in accordance with this invention.
Figure 4:
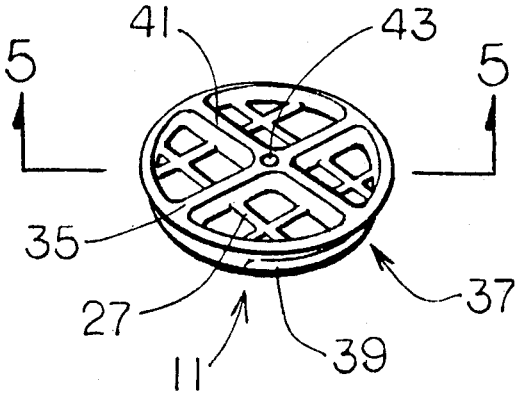
FIG. 4 of the drawings illustrates a side perspective view of the means for closing the opening to the laundering bag in accordance with this invention.
Figure 5:
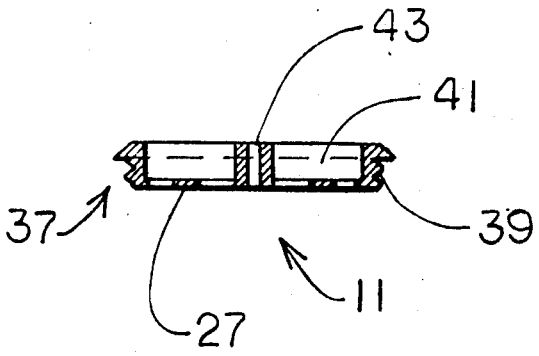
FIG. 5 of the drawings is a cross-sectional view along the plane indicated by the section line 5—5 of FIG. 4 showing the general construction of the means for closing the opening to the laundering bag in accordance with this invention.

The open weave fabric or plastic net comprises a longitudinal or side section 15 of the laundering bag 3 which is generally rectangular in shape. The two shorter sides of the rectangle, in one preferred form of the invention, are molded into the circular ribs 17 and 21 respectively, and the central portion of the rectangle is molded into circular rib 19, forming a barrel-shaped chamber 23 for receiving the items to be laundered. In addition, the open weave fabric or plastic net comprises an end section 25 of the laundering bag which is generally circular in shape and which, in one preferred form of the invention, is molded along its circumference into the circular rib 17 positioned at one end of the longitudinal section 15 of the open weave fabric or plastic net, forming the closed end of the barrel-shaped chamber 23. Both of these sections are readily apparent from the view illustrated in FIG. 2 of the drawings. The open weave fabric or plastic net further comprises a circular end section 27 which, in one preferred form of the invention, is molded along its circumference into the means 11 for closing the opening 9, as shown in FIGS. 3, 4 and 5. The open weave fabric or plastic net, in one preferred form of the invention, is made of PVC or polyvinylchloride. The flexibility of the product is desirable in both the agitating and tumbling processes for protection of all items being laundered. In addition, the non-absorbent character of the PVC contributes to a more efficient drying process. The relatively large spaces between the PVC strips in the open weave material promote effective laundering by insuring maximum exposure to the cleaning solution of the washing process and to the circulated air of the drying process.

The reinforcement structure 7 for the laundering bag 3, as shown in FIG. 1, comprises rigid, plastic circular ribs 17, 19 and 21. In one preferred form of the invention all three circular ribs are of solid plastic construction. In a second preferred form of the invention, circular rib 21 is of solid plastic construction and circular ribs 17 and 19 include periodic openings or holes in the plastic construction, which extend the depth or thickness of each rib, to further promote maximum exposure of the items being laundered to the cleaning solution and circulated air. Circular ribs 17 and 21 are of like diameter and are positioned at either end of the longitudinal section 15 of the open weave fabric or plastic net. Circular rib 19 has a slightly greater diameter than ribs 17 and 21 and is positioned central to the longitudinal section 15 of the open weave fabric or plastic net, giving the bag its barrel shape. The circular ribs serve to reinforce the walls of the laundering bag in an uncollapsed state so that the items within it are not unduly restricted, allowing the washing and drying processes to be unhampered.

Figure 6:
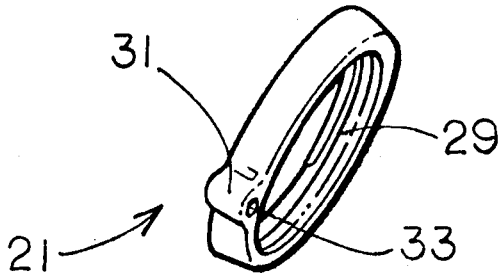
FIG. 6 of the drawings illustrates a perspective view of the top circular rib of the laundering bag in accordance with this invention, including the thickening on its outer surface and the chamber therein for receiving one end of the cord.

As shown in FIG. 1, circular rib 21 defines an opening 9 at the other end of the longitudinal section 15 of the open weave fabric or plastic net for receiving items to be laundered. From the view illustrated in FIG. 6 of the drawings, it is readily apparent that circular rib 21 includes threads 29 along its inner surface for connecting with the threads of means 11 for closing the opening 9. Circular rib 21 further includes a well-defined thickening 31 on its outer surface which extends the depth of the rib and defines an open-ended, cylindrical chamber 33. Chamber 33 houses one end of the cord 13 which permanently connects the circular rib defining the opening to the bag and the handle of the means for closing the opening to the bag.

FIGS. 3, 4 and 5 illustrate the means 11 for closing the opening 9 to the laundering bag, which comprises a rigid plastic circular rib 35 defining an opening 36. The means, similar to the means for closing a thermos, has walls 37 attached to and extending downward from the rim 35 with threads 39 along the outer surface of the walls for connecting with threads 29 along the inner surface of circular rib 21 defining the opening 9 of the laundering bag. Means 11 further comprises a cross-shaped rigid plastic handle 41 attached to the rim 35 for grasping while screwing or unscrewing the lid. The handle 41 extends in four directions across the opening 36 defined by rim 35. The central portion of handle 41 defines an open-ended chamber 43 which extends the depth of the handle 41. Chamber 43 houses one end of the cord 13 which permanently connects the circular rib defining the opening to the bag and the handle of the means for closing the opening to the bag.

The means 11 further includes a circular section 27 of open weave fabric or plastic net which, in one preferred form of the invention, is molded into the rim 35 at the underneath side of the handle 41 as illustrated in FIG. 5. This section 27 of the open weave fabric or plastic net maintains the items within the laundering bag when the means 11 is in closed position. In addition, means 11 comprises a lightweight plastic cord 13 for connecting the handle 41 of the means to the circular rib 21. One end of the cord 13 is retained in chamber 43 defined by the handle 41 and the other end of the cord 13 is retained in chamber 33 defined by the thickening 31 on the circular rib 21. The cord 13 includes a nodule at each end, nodule 45 illustrated in FIGS. 1 and 7 and the second nodule not shown, for maintaining cord 13 within chamber 33 and chamber 43, respectively.

Figure 7:
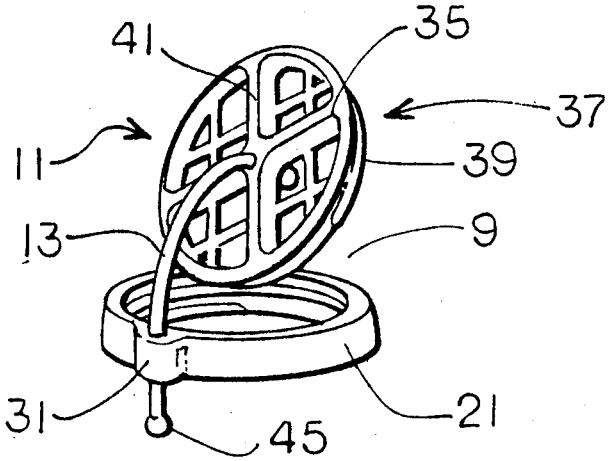
FIG. 7 of the drawings is a composition view of the means for closing the opening and the top circular rib in accordance with this invention, including the cord which permanently connects them and the manner in which they fit together.

FIG. 7 of the drawings illustrates the circular rib 21 defining the opening 9 of the laundering bag and the means 11 for closing the opening, including the connecting cord 13. In this view of the drawings, the means 11 and rib 21 are in proper position to be secured together for closing the opening 9.

It is thus seen that the laundering bag described herein has distinct advantages over other washing bags of the prior art. Not only does the reinforcement structure maintain the bag in an uncollapsed state to insure adequate washing and drying of the items inside, but the bag keeps items together during the cleaning process and separate from other items being washing and dried. This feature is particularly advantageous when laundering paired items, including socks, hose, mittens and gloves, for losing items during the laundering process is impossible.

In addition, the instant invention provides a bag for collecting items prior to laundering, for loosely confining the items during the washing and drying processes, insuring adequate laundering, and for storing the items until time for further use.

As variations of the instant invention will be apparent to one of skill in the art from a reading of the above specification, such variations are within the spirit and scope of this invention as defined by the following appended claims.

That which is claimed is:

1. A laundering bag for paired items comprising:

an open weave fabric or plastic net;

a reinforcement structure maintaining said open weave fabric or plastic net in an uncollapsed state;

said reinforcement structure defining an opening at one end of said open weave fabric or plastic net and formed of a plurality of circular ribs; and a means for closing said opening.

2. The laundering bag for paired items in accordance with claim 1 wherein said open weave fabric or plastic net comprises a longitudinal or side section and further comprising a circular end section for attaching to said means for closing said opening.

3. The laundering bag for paired items in accordance with claim 1 wherein said circular ribs comprise ribs of like diameter positioned at either end of said longitudinal section of said open weave fabric or plastic net and a third rib having a slightly greater diameter positioned central to said longitudinal section of said open weave fabric or plastic net.

4. The laundering bag for paired items in accordance with claim 2 wherein said longitudinal or side section is generally rectangular in shape and attaches to said circular ribs defining a barrel-shaped chamber for receiving items to be laundered.

5. The laundering bag for paired items in accordance with claim 2 wherein said end section is generally circular in shape and attaches to one said circular rib positioned at one end of said longitudinal section of open weave fabric or plastic net, forming a closing end of said barrel-shaped chamber.

6. The laundering bag for paired items in accordance with claim 3 wherein one said circular rib defines an opening at the other end of said longitudinal section of said open weave fabric or plastic net, said rib including threads along its inner surface for connecting with said means for closing said opening, and said rib further including a well-defined thickening on its outer surface extending the depth of said rib, said thickening defining an open-ended cylindrical chamber.

7. A laundering bag for paired items in accordance with claim 1 wherein said means for closing comprises a rigid plastic circular rim defining an opening and having walls attached to and extending downward from said rim with threads along the outer surface of said walls for connecting with threads along the inner surface of said circular rib defining said opening of said bag.

8. The laundering bag for paired items in accordance with claim 7 wherein said means for closing further comprises a cross-shaped rigid plastic handle attached to said rim extending in four directions across said opening defined by said rim, the central portion of said handle defining an open-ended chamber extending the depth of said handle.

9. The laundering bag for paired items in accordance with claim 8 wherein said means for closing further includes a circular section of open weave fabric or plastic net secured onto said rim by attaching along the underneath side of said handle for maintaining the items within the laundering bag when said means is in closed position.

10. The laundering bag for paired items in accordance with claim 1 wherein said means for closing said opening further comprises a lightweight plastic cord one end of said cord retained in said means for closing and the other end of said cord retained in one of said circular ribs.

11. The laundering bag for paired items in accordance with claim 10 wherein said cord includes a nodule at each end for maintaining said cord within said chambers.

12. A process for laundering paired items comprising:

providing open weave fabric or plastic net having an opening;

a reinforcement structure maintaining said open weave fabric or plastic net in an uncollapsed state;

the reinforcement structure comprising a plurality of circular ribs at one end of said open weave fabric or plastic net; and means for closing said opening; and collecting said paired items prior to laundering;

confining loosely said paired items during the washing and drying processes; and storing said items until time of further use.

* * * * *